US006095887A

United States Patent [19]

Llorens

[11] Patent Number: 6,095,887

[45] Date of Patent: Aug. 1, 2000

[54] DOLL CAPABLE OF WALKING WITH UNSTEADY STEPS AND WITH FALLING AND UPRIGHT RECOVERY MOTIONS

[75] Inventor: Jaime Ferri Llorens, Onil, Spain

[73] Assignee: Onilco Innovacion S.A., Onil, Spain

[21] Appl. No.: 09/222,205

[22] Filed: Dec. 29, 1998

[30] Foreign Application Priority Data

Feb. 24, 1998 [ES] Spain ..... 9800387
Nov. 30, 1998 [ES] Spain ..... 9802513

[51] Int. Cl.[7] ..... A63H 11/18

[52] U.S. Cl. ..... 446/355; 446/377

[58] Field of Search ..... 446/325, 330, 446/353, 354, 355, 377

[56] References Cited

U.S. PATENT DOCUMENTS

| | | | |
|---|---|---|---|
| 3,514,899 | 6/1970 | Bonnano et al. | 446/354 |
| 3,583,098 | 6/1971 | Bear | 446/355 |
| 4,312,150 | 1/1982 | Terzian | 446/354 |
| 4,563,163 | 1/1986 | Herbstler et al. | 446/354 |
| 4,795,395 | 1/1989 | Oishi et al. | 446/355 |
| 5,088,954 | 2/1992 | Terzian et al. | 446/355 |
| 5,224,896 | 7/1993 | Terzian | 446/353 |

*Primary Examiner*—Sam Rimell
*Assistant Examiner*—Jeffrey D. Carlson
*Attorney, Agent, or Firm*—Ladas & Parry

[57] ABSTRACT

The mechanism comprises an electric motor 12 capable of rotating in two directions and transmitting rotational movement through an endless belt 14 and two reducer trains 15, 16 to a clutch assembly 17 comprising a center drive wheel 18 and two driven wheels or pinions 19, 20, one on each side, which rotate in a mutually excluding manner depending on the rotational direction of drive wheel 18, its facing side surfaces presenting saw teeth 21, 22 of an appropriate configuration. When the mechanism is activated by removing the pacifier 5 from the doll's mouth, a first phase is executed, consisting in an unsteady walking motion generated by eccentric discs 25 and connecting rods 26, 27; after a specified time has elapsed, this passes on to a second phase consisting in a fall and subsequent upright recovery of the doll, driven by a central wheel 32. FIG. 7.

4 Claims, 14 Drawing Sheets

DOLL CAPABLE OF WALKING WITH UNSTEADY STEPS AND WITH FALLING AND UPRIGHT RECOVERY MOTIONS

DESCRIPTION

The object of the present invention consists in a mechanism for a doll that walks with unsteady steps and is provided with falling and upright recovery motions.

This invention applies to the toy industry, specifically to dolls and toy figures, and to the internal moving mechanisms thereof.

Movement of the doll starts when the pacifier is removed from the doll's mouth, in an initial phase in which the doll advance with unsteady steps while emitting a babbling sound.

If at this moment the doll is held by both hands, the babbling noise turns to laughter while the doll continues to advance indefinitely with its unsteady walking motion.

If one or both arms are released, after a time the doll stimulates a falling position by lowering its arms and resting them on the floor while tilting the trunk forwards. When the hands touch the floor, the arms seem to yield towards the front while the legs open, both at the same time, one towards the front and the other towards the rear. Simultaneous to this falling operation, the head lifts backwards so that the direction of the eyes is maintained substantially forwards. Finally, the overall movement is reversed and the doll manages to stand up. During the whole of this second phase of the movement, the doll calls for its mom.

In order to achieve these complex movements, the doll is fitted with a mechanism installed in the trunk and driven by a small electric motor fed from batteries installed inside the shoes. The electric motor is able to drive, in both rotation directions, a clutch assembly comprising a central drive wheel and two side-driven wheels or pinions, one on each side, which rotate in a mutually excluding manner depending on the rotation direction of the drive wheel, in view that its laterally facing surfaces are fitted with saw teeth of an appropriate design.

Thus, when the electric motor and the clutch assembly rotate in a first direction, this produces the previously described movement of the first phase as a result of the rotation of both opposite eccentric discs attached to two free connecting rods which consequently receive a substantially vertical reciprocating movement which is in turn transmitted to the legs through an intermediate auxiliary fork to provide the unsteady walking motion.

When the timer-driven electric motor and clutch assembly rotate in a second direction, this generates the previously described second phase movements via an arm rotating wheel fitted with a side face channel in which is inserted a stub attached to a sliding rack along the diameter of the wheel. This rack in turn meshes with a coaxial pinion integral to the arm rotating shaft to produce arm movement. Parallel to this movement, a central wheel presenting respective channels on its sides for lodging the stubs fitted on two oscillating levers located one on each side of the central wheel and hinged at a point adjacent the doll's shoulders is turning. Each oscillating lever ends, at a lower part thereof, farthest from the oscillating shaft, in an oscillating toothed sector which meshes with a toothed circular sector joined in rotating fashion to a respective leg, although allowing for diametrical oscillation of same. This enables relative movement between the trunk and the legs, thereby achieving an absolute movement for the trunk or the legs as a function of the convenient immobilized condition of the other element. These movements are performed with a great deal of precision, smoothness and realism, deriving from the channel-stub coupling, and may be different for each leg in view that each has its own associated central wheel side channel. Furthermore, an outward movement of the legs is achieved, simultaneous to the rotation of the legs, as a result of the joint axes being substantially outward and downwards, as opposed to horizontally, oriented.

These and other features of the invention will become more evident on the basis of the description provided hereunder and the figures attached to this specification, forming a part thereof, in which.

In the above figures, the numerical references correspond to the following parts and elements:

1. Trunk

2. Arms

Figure 1:
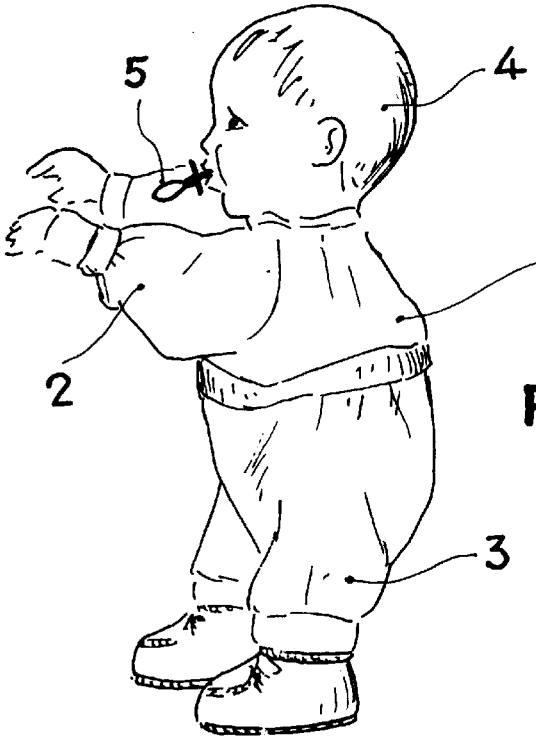
FIG. 1 shows an upright view of the inventive doll wherein the doll is offering its arms to the user.
Figure 2:
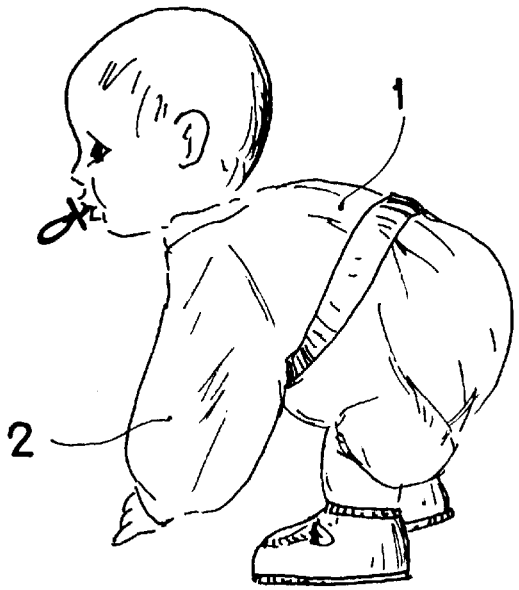
FIG. 2 shows a view of the inventive doll wherein the doll is starting to fall, its trunk slanting forwards while its arms are lowered to lean on the floor.
Figure 3:
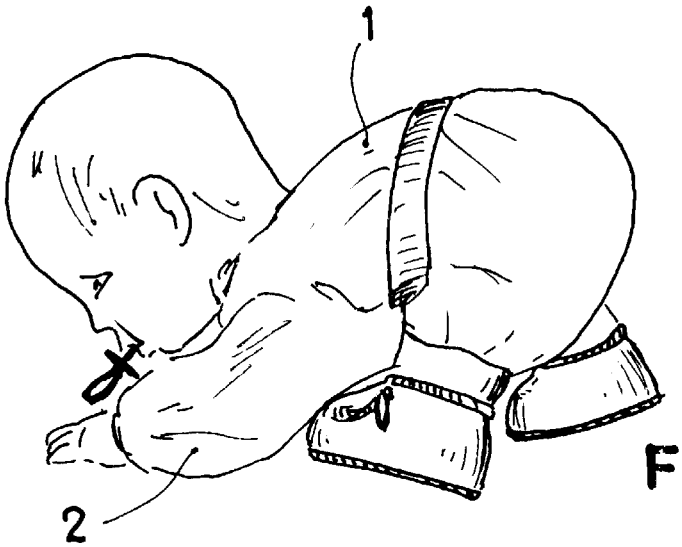
FIG. 3 shows a view of the inventive doll wherein the doll has completed its fall, its trunk is far more slanted, its arms have slid along the floor and its legs are open outward, with one extending forwards and the other backwards.

3. Legs
4. Head
5. Pacifier
6. Arm shaft
7. Leg joints
8. Head fork
9. Head fork protrusions
10. Head spring
11. Leg springs
12. Electric motor
13. Motor pulley
14. Endless belt
15. First reducer train
16. Second reducer train
17. Clutch assembly
18. Drive wheel
19. 1st phase driven wheel
20. 2nd phase driven wheel
21. 1st phase saw teeth
22. 2nd phase saw teeth
23. 1st phase shaft pinion
24. 1st phase shaft
25. Opposite eccentric discs
26. Free connecting rod, left
27. Free connecting rod, right
28. 2nd phase shaft wheel
29. 2nd phase shaft
30. First 2nd phase pinion
31. Second 2nd phase pinion
32. Central wheel
33. Arm wheel
34. Arm channel
35. Arm wheel shaft
36. Rack stub
37. Rack
38. Arm pinion
39. Rack grooves
40. Trunk channel
41. Trunk stub
42. Oscillating lever
43. Oscillating SHAFT
44. Shoes
45. Batteries
46. Rectangular sliding zone
47. Rectangular routing
48. Screws
49. Joint support
50. Leg attachment stubs
51. Joint bearing
52. Circular toothed sector
53. Leg stubs
54. Leg forks
55. Fork shaft
56. Connecting rod stubs
57. Head cam
58. Indentations
59. Driven stub
60. Head auxiliary lever
61. Head stub
62. Head fork groove
63. Sound device
64. Stop microswitch
65. Clutch spring
66. Oscillating toothed sector
67. Inner spring
68. Leg spring support
69. Hand switch
70. Oscillating lever groove As shown in FIG. 1, the doll that is the object of the invention comprises a trunk 1 with jointed arms 2 and legs 3 capable of moving in response to orders from the internal mechanism. The head 4 moves in a front-to-rear direction, accompanying the movement of the trunk, as described further on, and may be rotated by hand to any desired lateral position. A pacifier 5 activates the internal mechanism when removed from the doll's mouth.

Figure 4:
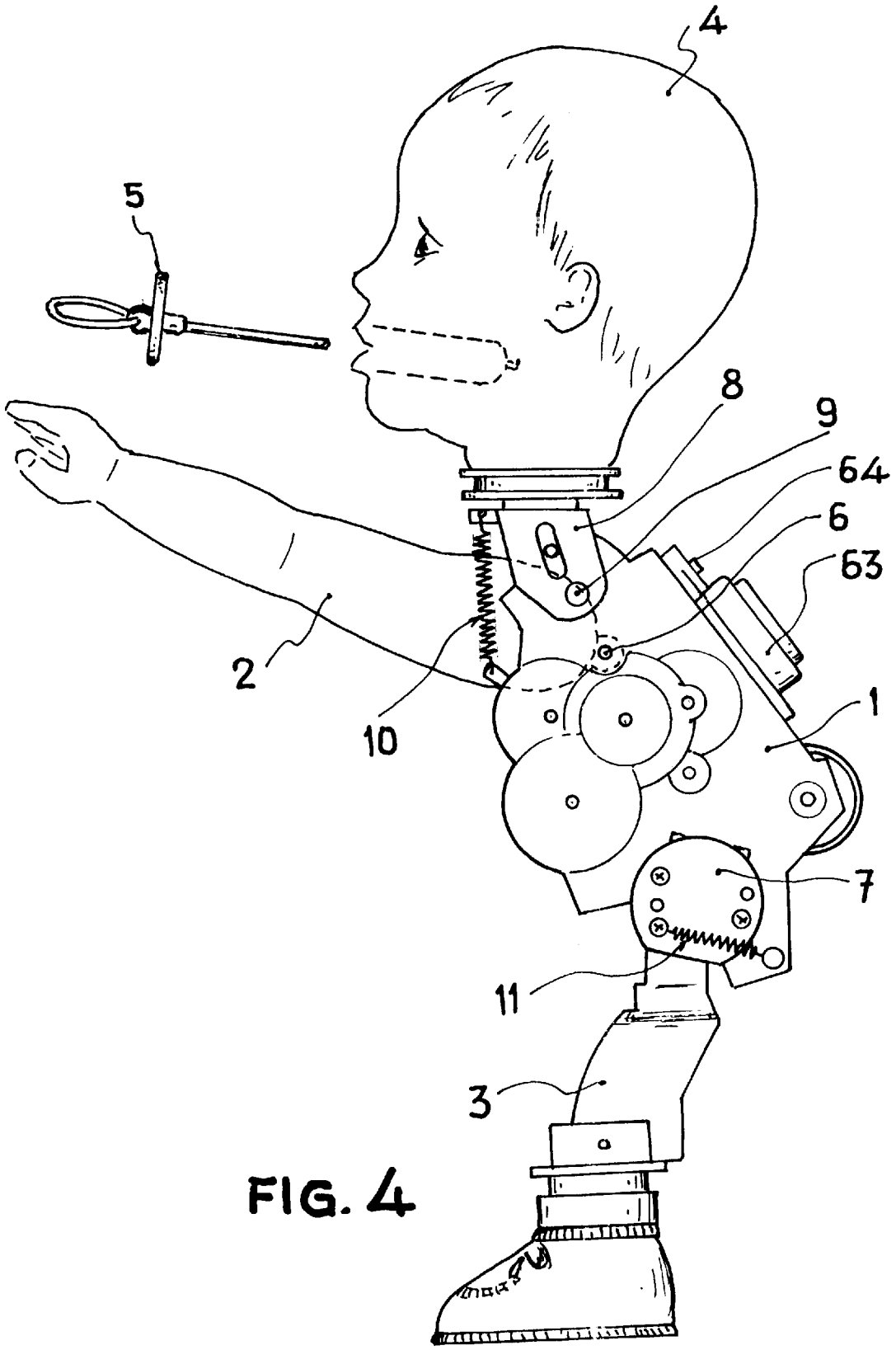
FIG. 4 shows a left side view of the inventive doll with its dress removed to reveal the mounting of its limbs.

FIG. 4 shows the internal mechanism in the trunk 1 of the doll that is the object of the invention, the arms 2 being jointed over an arm shaft 6 and the legs 3 over respective leg joints 7. The head 4 is mounted on a head fork 8 that rotates over two fork protrusions 9 integral to the doll's trunk 1. A head spring 10 attaches the head 4 to the trunk 1 to provide it with improved smoothness of motion while a leg spring 11 partially balances the weight of the trunk 1 when the trunk is in a horizontal position.

Figure 5:
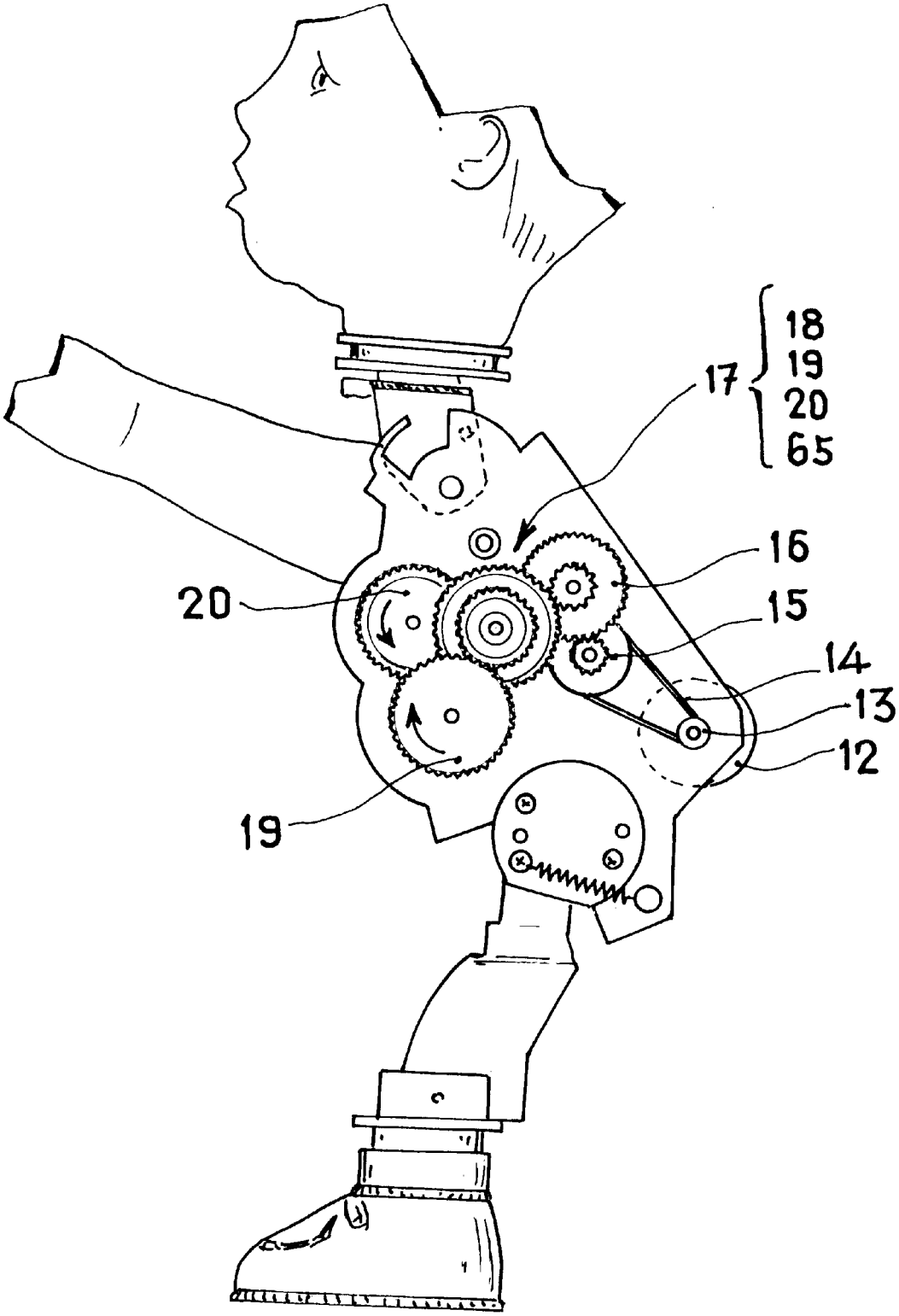
FIG. 5 shows the same view as in FIG. 4, with the cover removed and thus enabling the general position of the motor, the reducer and the clutch assembly to be appreciated.
Figure 6:
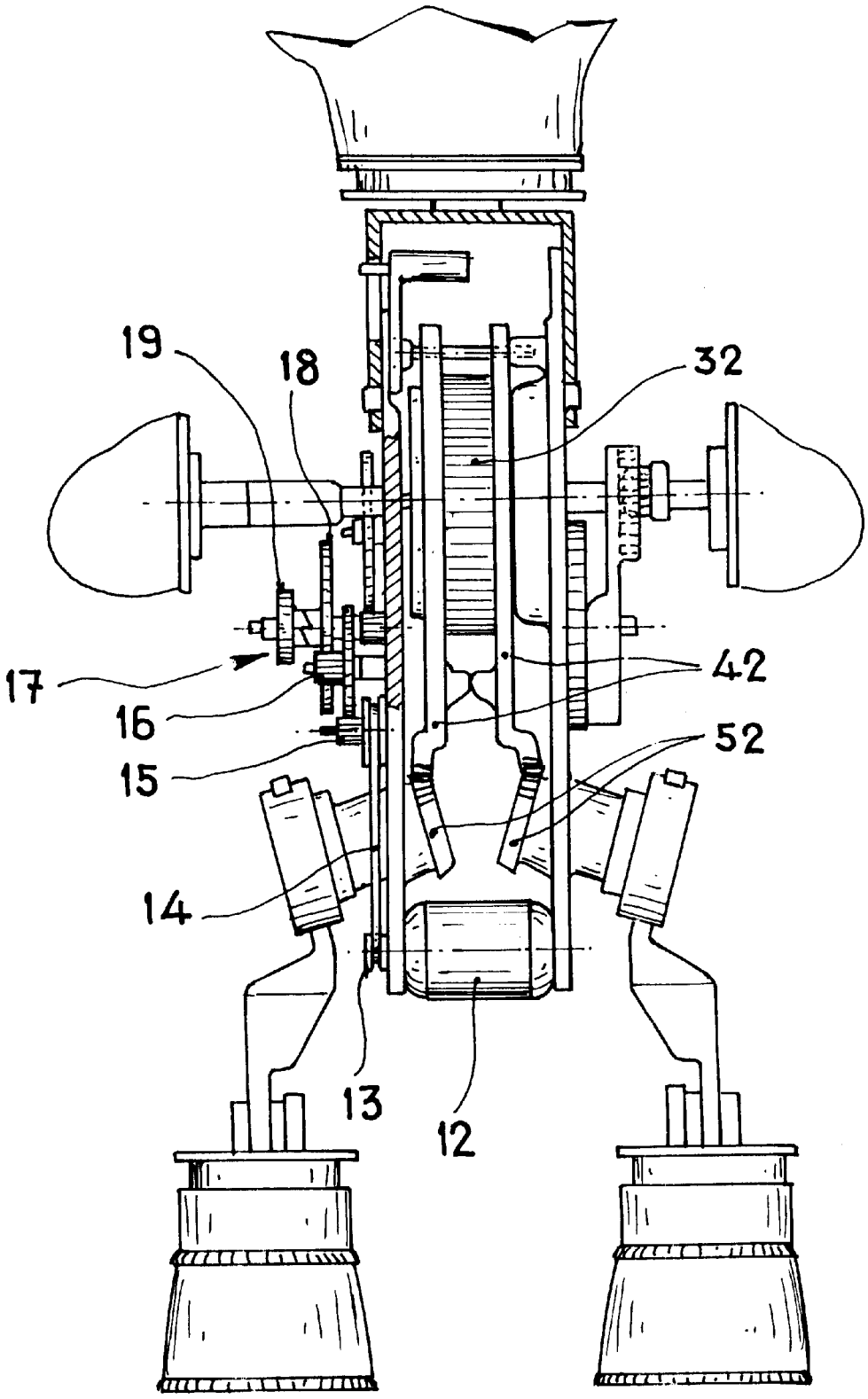
FIG. 6 shows a view from the back of the inventive doll that reveals the overall mechanism.
Figure 7:
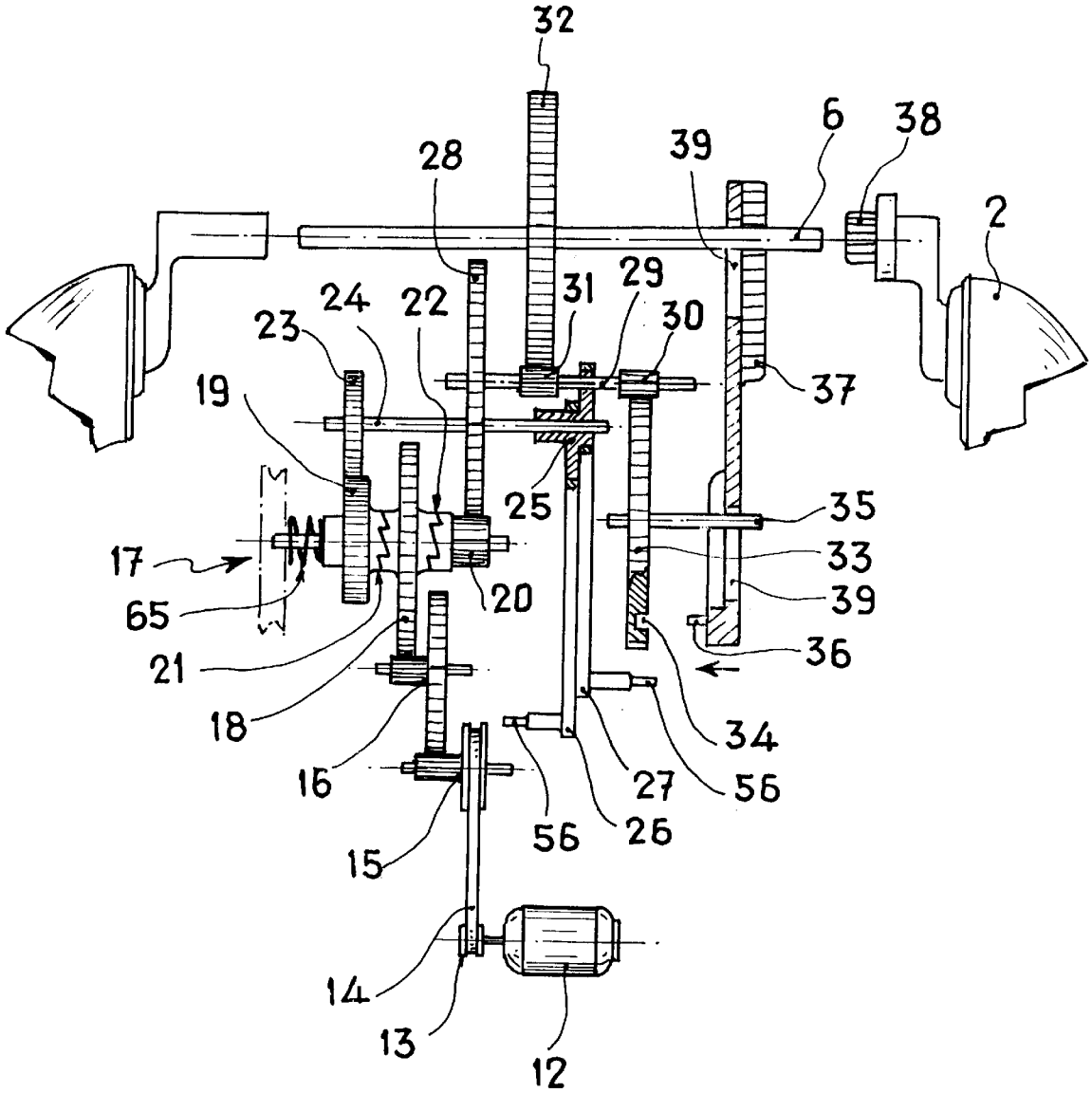
FIG. 7 shows a schematic detail of the main parts in the drive mechanism as seen from a view similar to that in FIG. 6.
Figure 8:
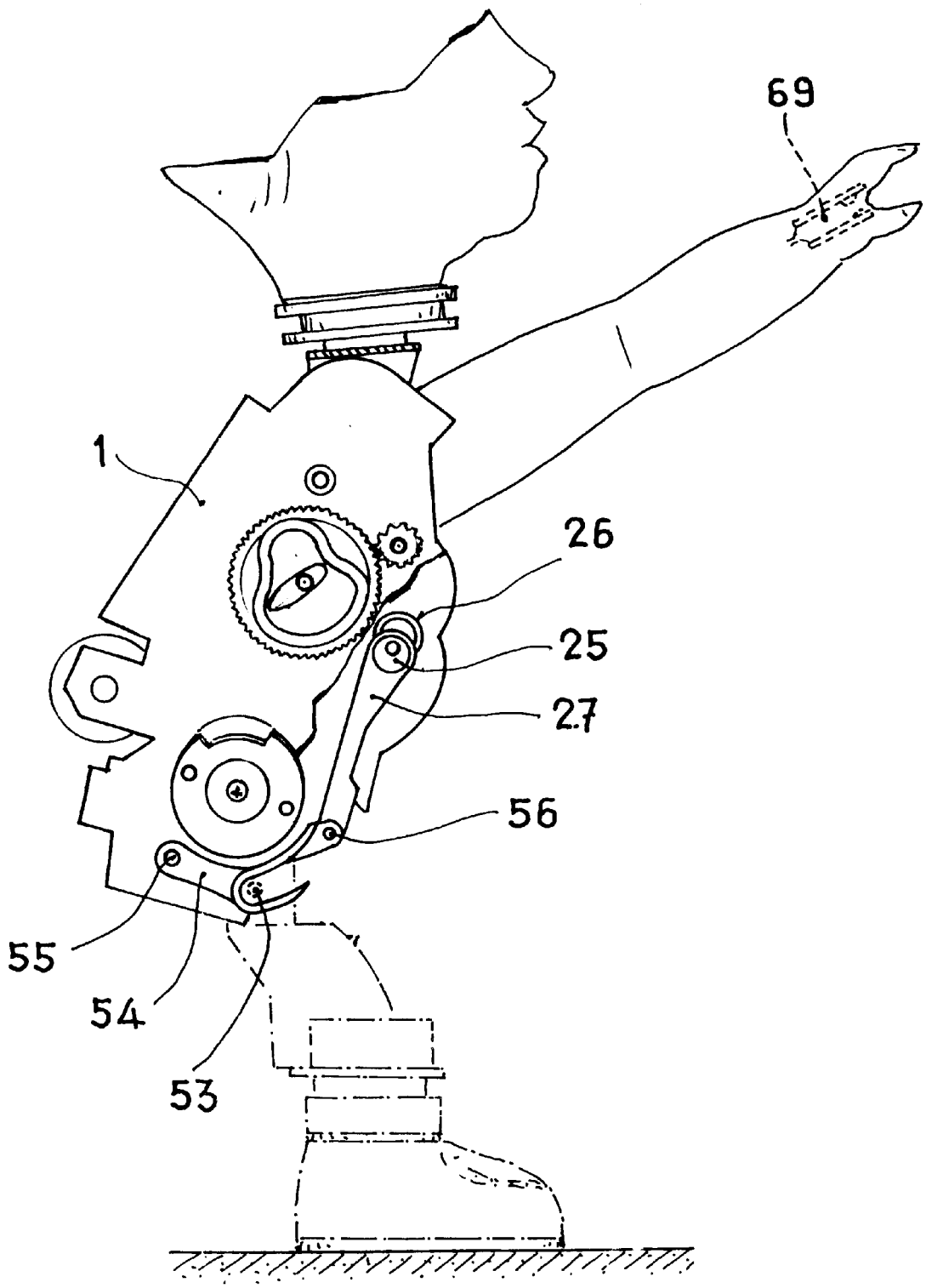
FIG. 8 shows a view of the inventive doll from its right hand side, with the leg in the lower position, and basically shows the main parts involved in the unsteady walking motion.
Figure 9:
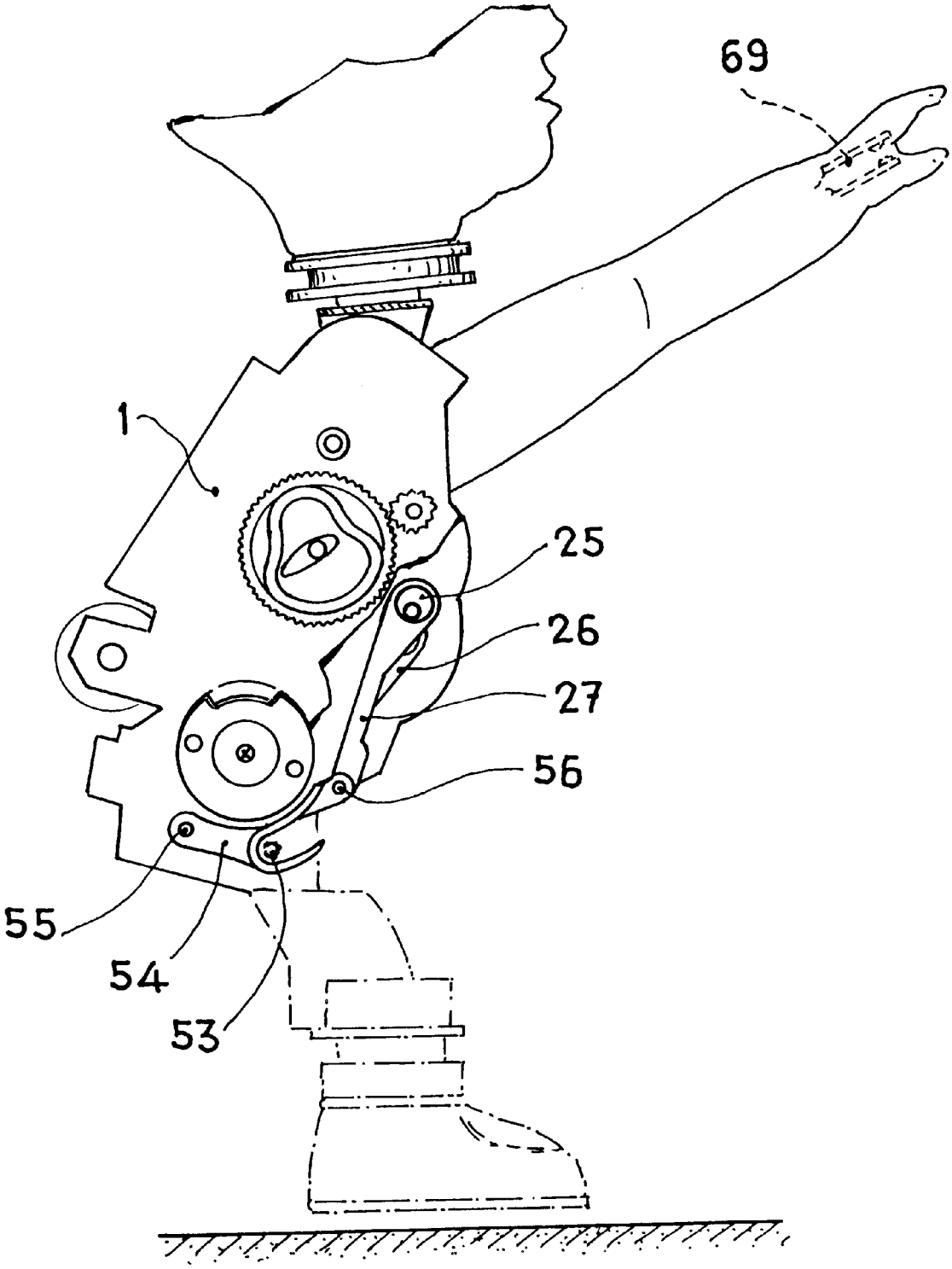
FIG. 9 is identical to FIG. 8, save that the leg is in the upper position.

As can be seen in FIGS. 5, 6, 7, the trunk 1 is fitted with an electric motor 12, the motor pulley 13 of which couples onto an endless belt 14. The belt moves a set of reducer trains 15 and 16 which transmit movement to the clutch assembly 17, composed of a drive wheel 18, a driven wheel 19 and a driven pinion 20 located one on each side of and coaxial to the drive wheel 18 which provides motion through facing front sides having respective surfaces in the form of associated saw tooth 21 and 22.

It is evident that even though the cut of saw teeth 21 and 22 is the same, each driven wheel and pinion 19, 20 can be rotated only in opposite directions in respect to drive wheel 18. As a result of this, and depending on the rotation direction of the motor 12, which may be reversed by merely inverting the polarity of the electric supply, the first phase driven wheel 19 or the second phase driven pinion 20 are made to rotate.

Meshed with the first phase driven wheel 19, the mechanism presents a first phase shaft pinion 23, the integral shaft 24 of which drives two opposite eccentric discs 25. Onto these discs are attached respective free connecting rods 26, 27; upon rotation of the first phase shaft 24 and the associated opposite eccentric discs 25, reciprocating vertical movement of the free connecting rods 26, 27 is generated. Furthermore, and meshing with second phase driven pinion 20, the mechanism presents a second phase shaft wheel 28 integral to the second phase shaft 29 bearing two integrally rotating second phase pinions 30, 31.

Figure 10:
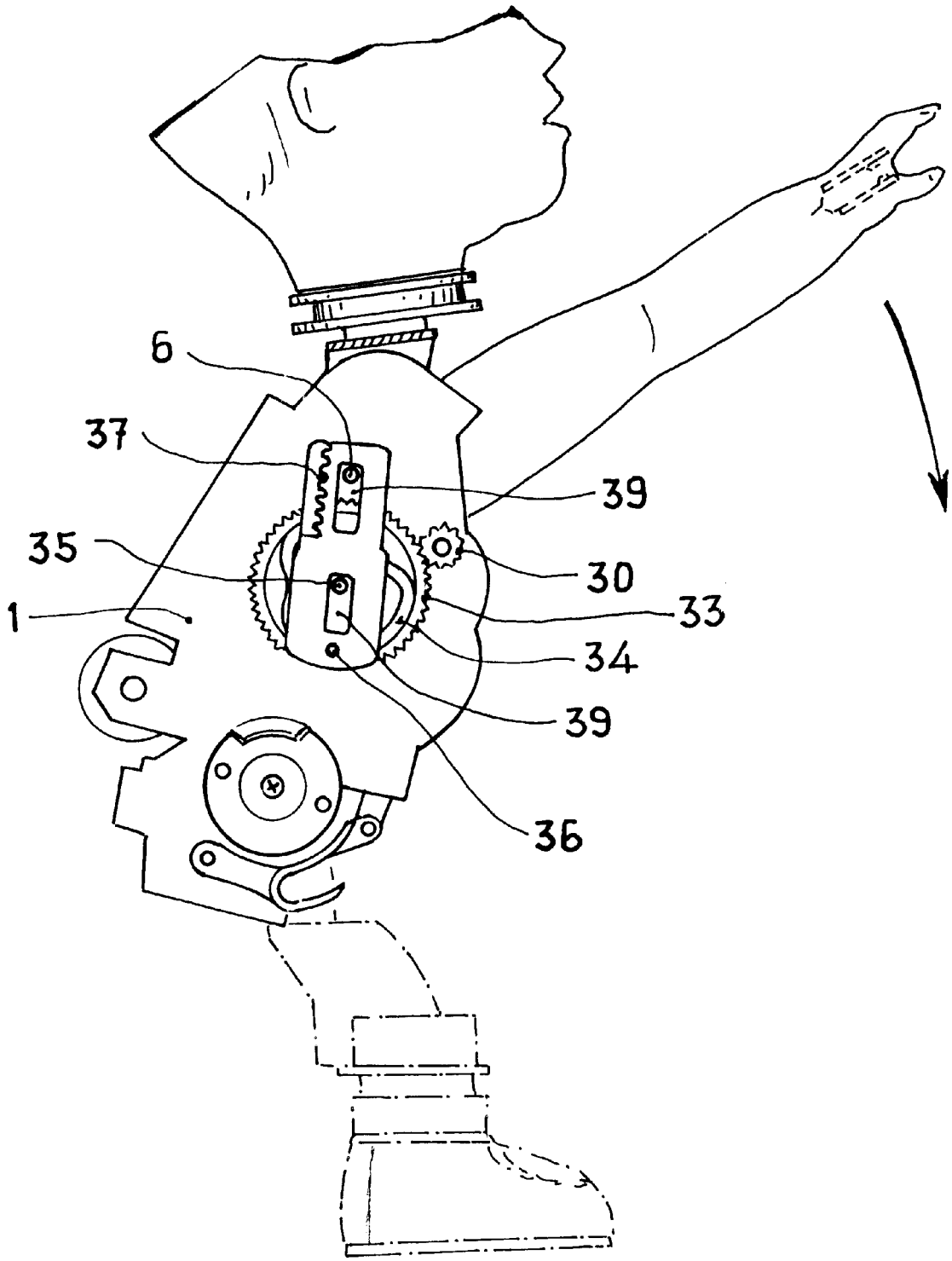
FIG. 10 is a view similar to FIG. 8, although it basically shows the parts involved in the relative movement between trunk and legs.

The first 2nd phase pinion 30 meshes with a toothed arm wheel 33 with an arm channel 34 on its front face placed at a variable distance from shaft 35 of arm wheel 33 (see FIGS. 7 and 10). In this arm channel 34 is inserted a stub 36 of a rack 37 which meshes with an arm pinion 38 coaxial and integral to arm shaft 6 and to arm 2 (for the purpose of clarity, FIG. 7 shows an exploded view of rack 37 and arm 2). For a 360° rotation of the arm wheel 33, the rack 37 performs a reciprocating linear movement in the direction of the arrow, thereby providing oscillating rotation to arm pinion 38, and consequently to both arms 2. The linear movement of rack 37 derives from the fact that the rack's movement is limited by the arm shaft 6 and the arm wheel shaft 35 which cross the rack 37 along respective aligned rack grooves 39 (see FIG. 10).

Figure 11:
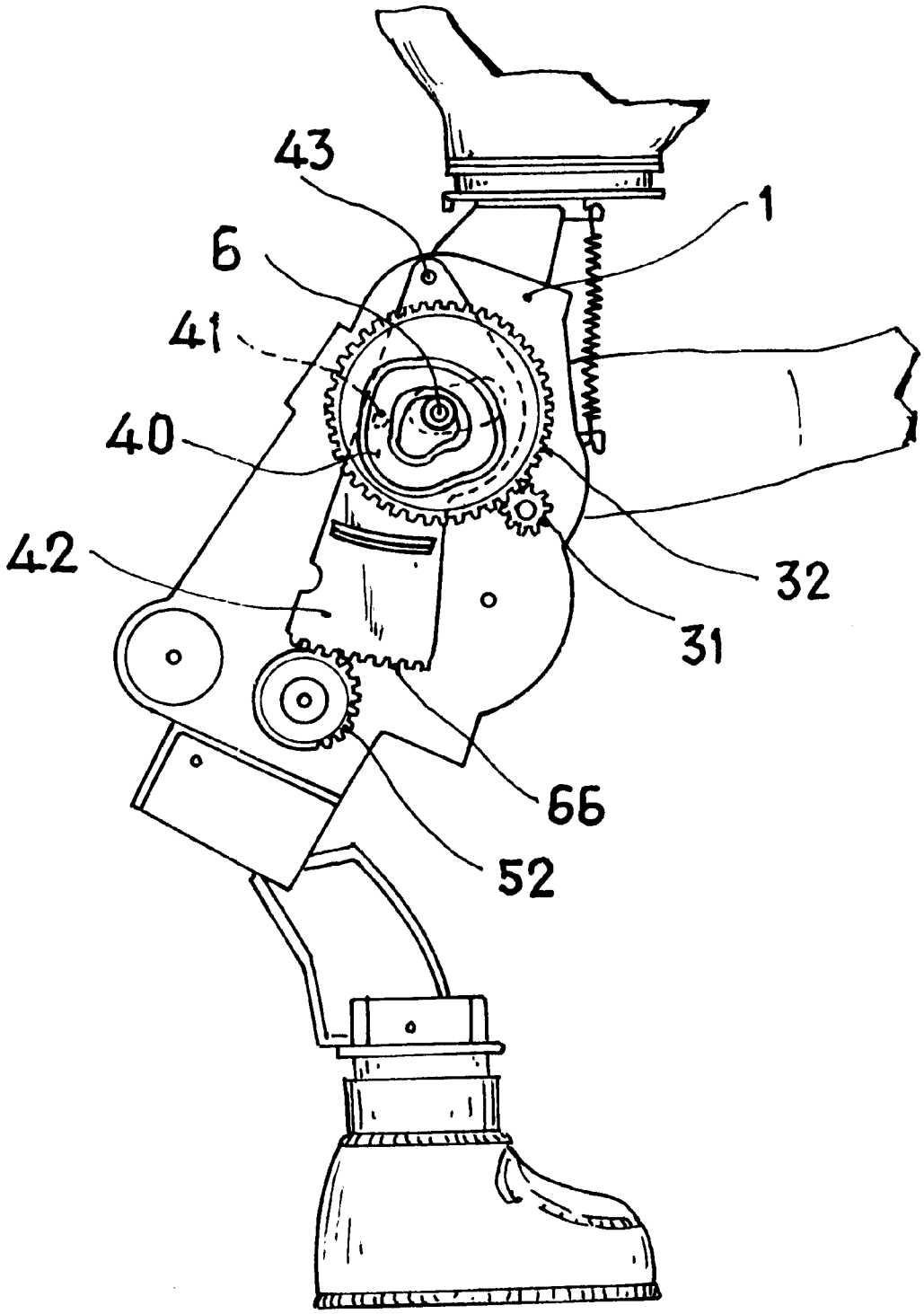
FIG. 11 shows a view of the inventive doll from its right hand side, basically revealing the parts involved in the relative movement between trunk and legs.
Figure 12:
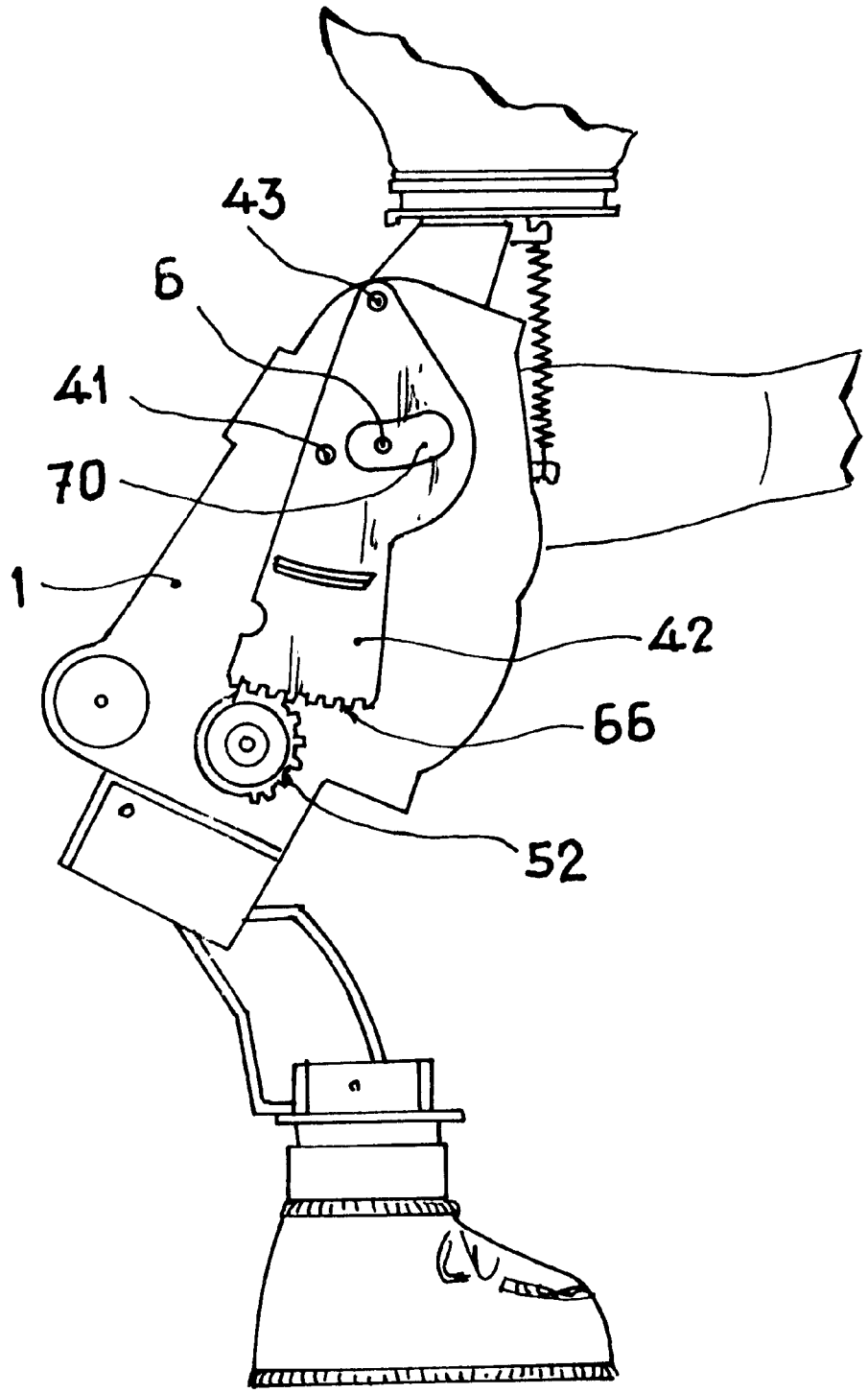
FIG. 12 is similar to FIG. 11, although the central wheel has been removed in order to show the characteristics of the side levers.

Furthermore, and referring to FIGS. 7, 11 and 12, the second 2nd phase pinion 31 meshes with central wheel 32 which rotates freely around arm shaft 6. This central wheel 32 presents, on each of its faces, a trunk channel 40 placed at a variable distance from arm shaft 6, into which channel is inserted the trunk stub 41 of oscillating lever 42 that is hinged onto an oscillating shaft 43 fixed to the doll's trunk 1 and is provided with a groove 70 allowing the arm shaft 6 to pass.

Referring to FIGS. 8, 9, 15 and 16, the doll's legs 3 finish at their lower end in a shoe 44 containing batteries 45 for electrically driving the doll's mechanism. The doll's overall center of gravity is thus lowered, improving the doll's stability and enabling it to raise itself back to an upright position. The upper end of the doll's legs 3 finish in a sliding zone 46 having the general form of a rectangular section plate strongly angled towards the exterior. This rectangular sliding zone 46 can move freely in an axial direction in view that it is housed in a rectangular routing 47 lodging the leg joints 7. In this manner, the leg 3 can rotate when driven by leg joints 7 and can furthermore slide in both directions of the leg joint 7 diameter. The legs 3 can thus move in a vertical directions when a leg stub 53 is acted on by a leg fork 54 which, being hinged to a fork shaft 55 attached to trunk 1, receives an oscillating movement through stubs 56 in the free connecting rods 26 and 27. When the trunk 1 is fully flexed, the leg stub 53 is located outside the leg fork 54, and therefore the position of leg 3 is defined axially by the action of an inner spring 67 which presses the support 68 of leg joint 7 and acts downwards on the sliding zone 46 of leg 3.

Leg joint 7, housing the sliding zone 46 of leg 3 in its rectangular routing 47, is mounted by means of two screws 48 on a joint support 49 fitted with two attachment stubs 50 which penetrate in the corresponding holes in leg joint 7 and guarantee an exact angular positioning of the joint and consequently of the leg.

Figure 16:
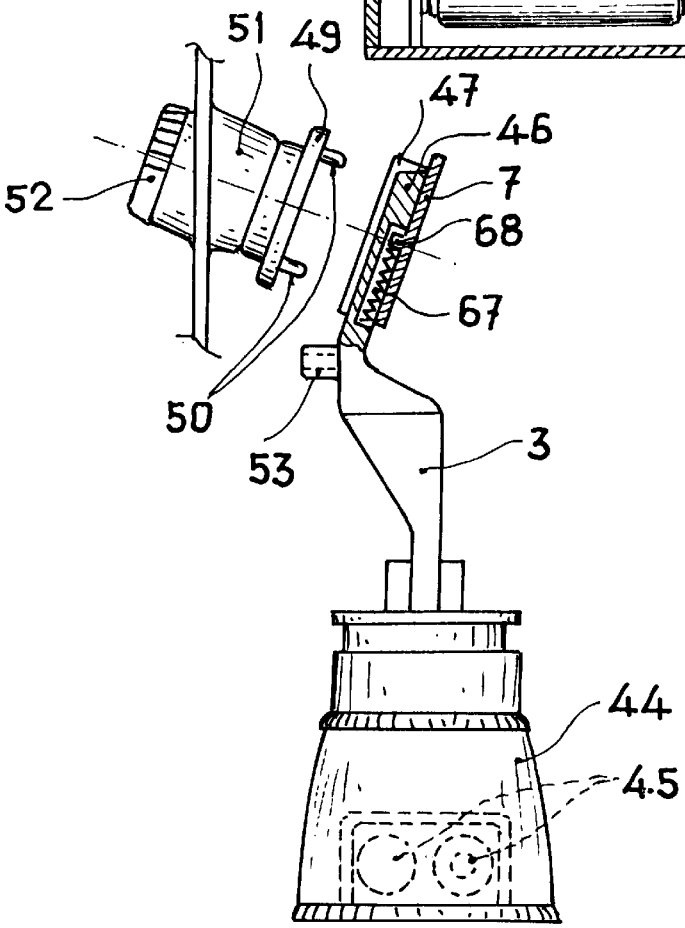
FIG. 16 shows a rear view of the leg shown in FIG. 15, with the leg in an exploded view in regard to the joint.

Finally, joint support 49, capable of rotating freely inside a joint bearing 51 attached to trunk 1, presents a circular toothed sector 52 which meshes with a toothed sector fitted on oscillating lever 42 (see FIGS. 11 and 16).

Figure 17:
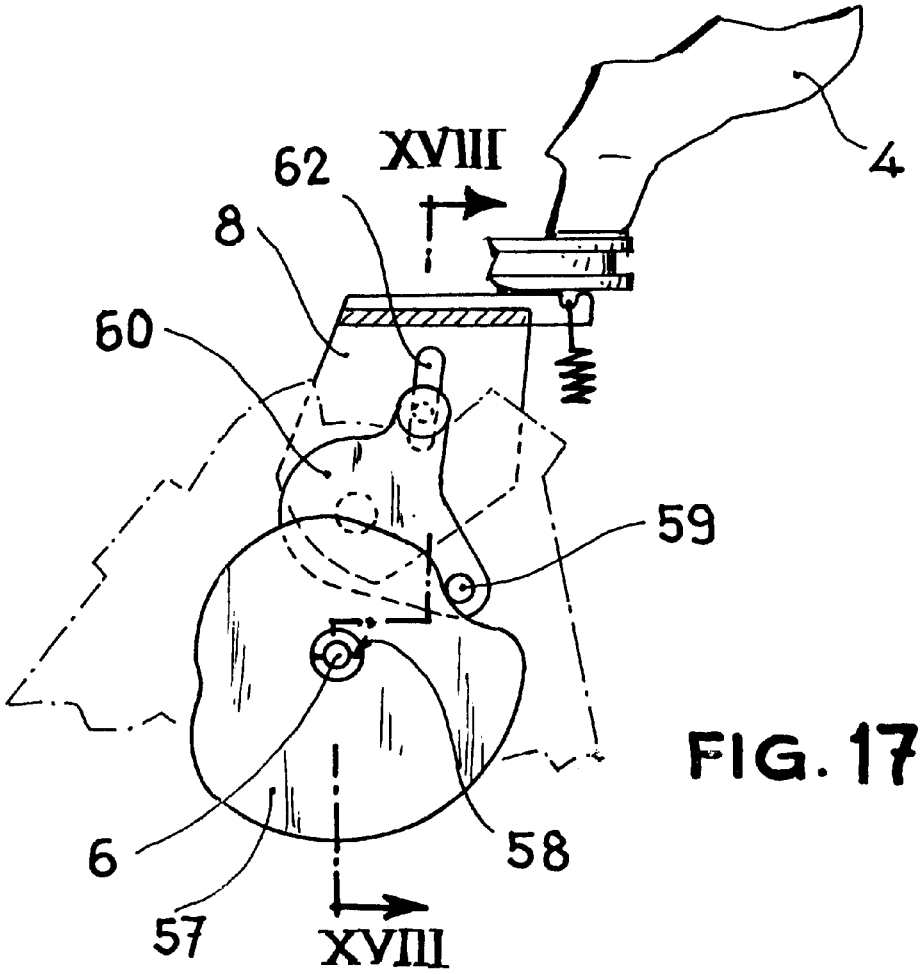
FIG. 17 shows a detail from the right side of the inventive doll, depicting the head movement mechanism.
Figure 18:
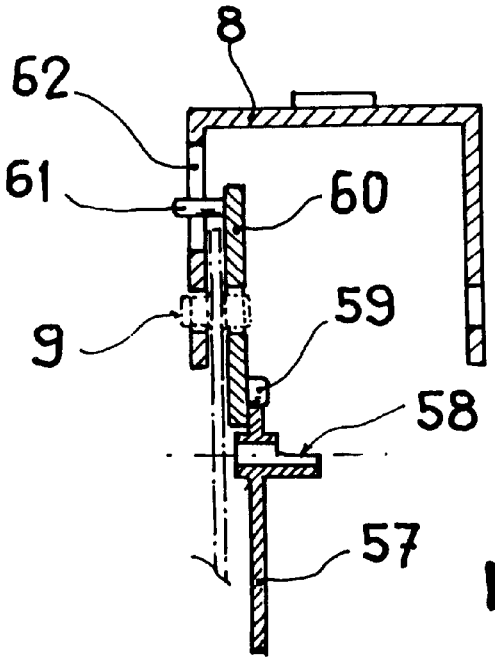
FIG. 18 shows a rear sectional view of the detail depicted in FIG. 17.

Arm shaft 6 carries a freely rotating head cam 57 which is moved by the central wheel 32 through indentations 58 in the facing surfaces of both parts. This head cam 57 acts on a driven stub 59 in a head auxiliary lever 60 hinged over an inner projection of head fork protrusions 9, enabling the head 4 to move when acted upon by head stub 61 in groove 62 of head fork 8 (see FIGS. 17 and 18).

Trunk 1 is fitted with a sound emitting device 63 and a microswitch 64 activated by central wheel 32.

Operation of the mechanism is as follows:

When the pacifier 5 is removed from the doll's head 4, the electric motor 12 is activated by batteries 45. Movement is transmitted through motor pulley 13, endless belt 14, first reducer train 15 and second reducer train 16 up to drive wheel 18 of clutch assembly 17. Rotation of drive wheel 18 is counter-clockwise (as viewed in FIG. 5), causing the first phase driven wheel 19 to move by the action of the first phase saw tooth 21 (see FIG. 7). It is apparent that second phase saw teeth 22 work in the direction of the slanting surfaces, so that the second phase driven pinion 20 is not pulled in view that the overall assembly is offset towards the left, thereby pressing the clutch spring 65. As a result of this, the first phase shaft pinion 23 rotates, carrying with it the first phase shaft 24 and the opposite eccentrics discs 25, generating the vertical reciprocating movement of the free connecting rods 26, 27. Each of these free connecting rods 26, 27 is fitted with a free connecting rod stub 56 which transmits reciprocating movement to leg fork 54 which, upon securing leg stub 53, conveys a vertical reciprocating movement to leg 3 in respect to the doll's trunk 1 and thus simulates an unsteady walking motion (see FIGS. 8 and 9).

If in this situation both hands of the doll are held simultaneously in an attitude of helping the doll to walk, the electric switches 69 are activated inside the flexible hands, so that this first phase of the doll's movement is maintained indefinitely and without further variation, save for the sound emitted by the doll, which turns from a babbling noise to one of laughter expressing happiness. The sound device 63 is attached to the rear portion of trunk 1, as can be seen in FIG. 4. This device may correspond to any of the known types found in the market; we shall not describe its electrical connections to the various elements in view that these may be easily understood by any expert on the subject.

If the doll's hands are released, the doll continues to walk for some time with its unsteady gait and babbling noise, while a conventional timer is activated which after a specified period of time reverses the rotation of electric motor 12 and thus starts the second phase of the doll's movement. In this second phase, in which the doll simulates a falling and recovery movement, the babbling becomes a call for its mom while the trunk acquires a tilting stance, the legs become separated and the arms lowered and ready to rest on the floor. These movements are achieved through the rotation of motor 12 in the direction opposite that of the first phase, transmitted through motor pulley 13, endless belt 14, first reducer train 15, second reducer train 16 and drive wheel 18 in clutch assembly 17. Since the drive wheel 18 is now rotating clockwise, as can be seen in FIG. 5, the second phase driven pinion 20 is driven by the second phase saw teeth 22 and the first phase driven wheel 19 rotation stops, the wheel moving to the right and pressing the clutch spring 65 as it is pushed by the movement of the first phase saw teeth 21. In this manner, the second phase shaft wheel 28 and the first and second 2nd phase pinions 30, 31 rotate together with common second phase shaft 29.

As shown in FIG. 10, the first 2nd phase pinion 30 moves the arms 2 via arm wheel 33, arm channel 34, rack stub 36, rack 37 and arm pinion 38, with arm channel 34 presenting an appropriate configuration designed to achieve the desired coordination of arms movement and simultaneous trunk and legs movement.

Figure 13:
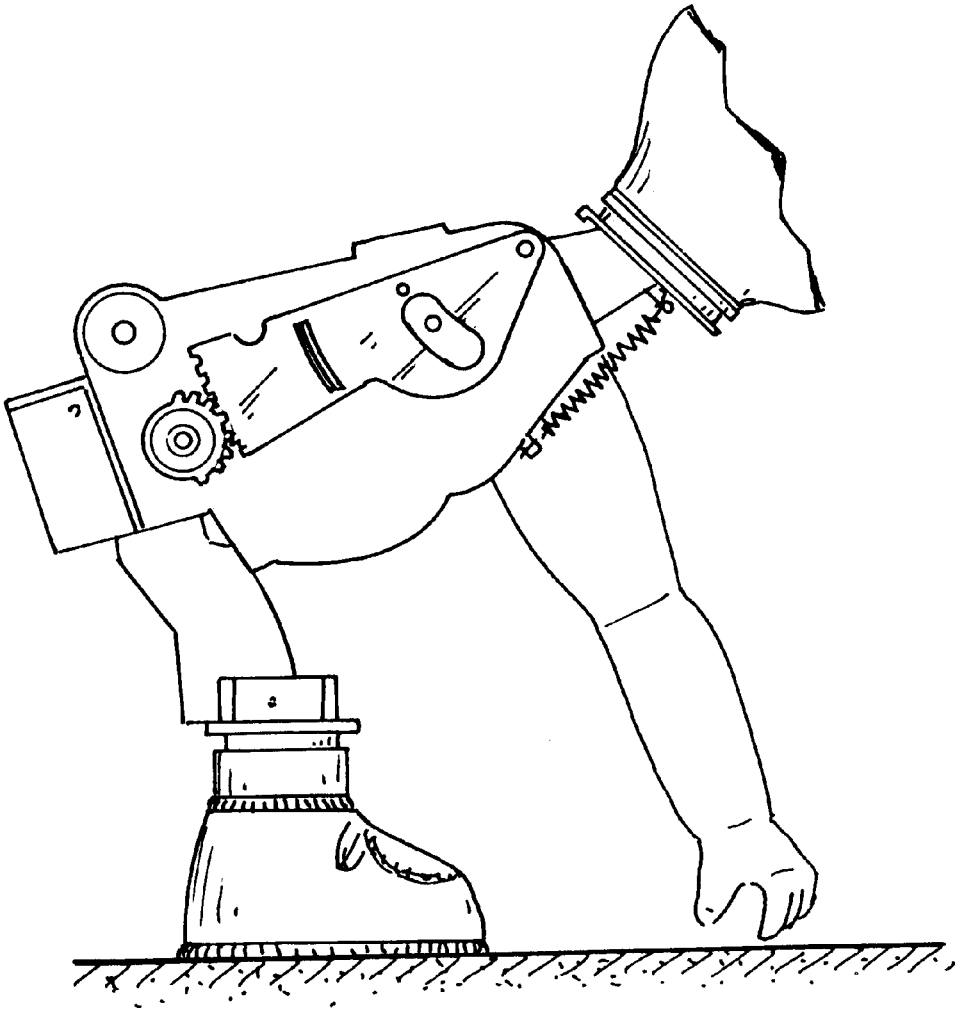
FIG. 13 is similar to FIG. 12, showing a different relative position for the trunk and legs.

As shown in FIGS. 11, 12, 13 and 14, the second 2nd phase pinion 31 generates the initial forward movement of the trunk, up to a point where the arms rest on the floor, as shown in FIG. 13. This is achieved by the rotation of central wheel 32, the trunk channel 40 of which pulls the trunk stub 41 and with it the oscillating lever 42 which rotates around its oscillating shaft 43. The oscillating toothed sector 66 at the end of oscillating lever 42 thus varies its relative position in respect to the toothed circular sector 52 that is rotatingly attached to the legs 3; in view that the legs are unable to move because of the weight of the batteries 45 inside the shoes 44 and the leg's resting position on the floor, the whole of the doll's trunk 1 tilts forwards (see sequence in FIGS. 12 and 13).

Figure 14:
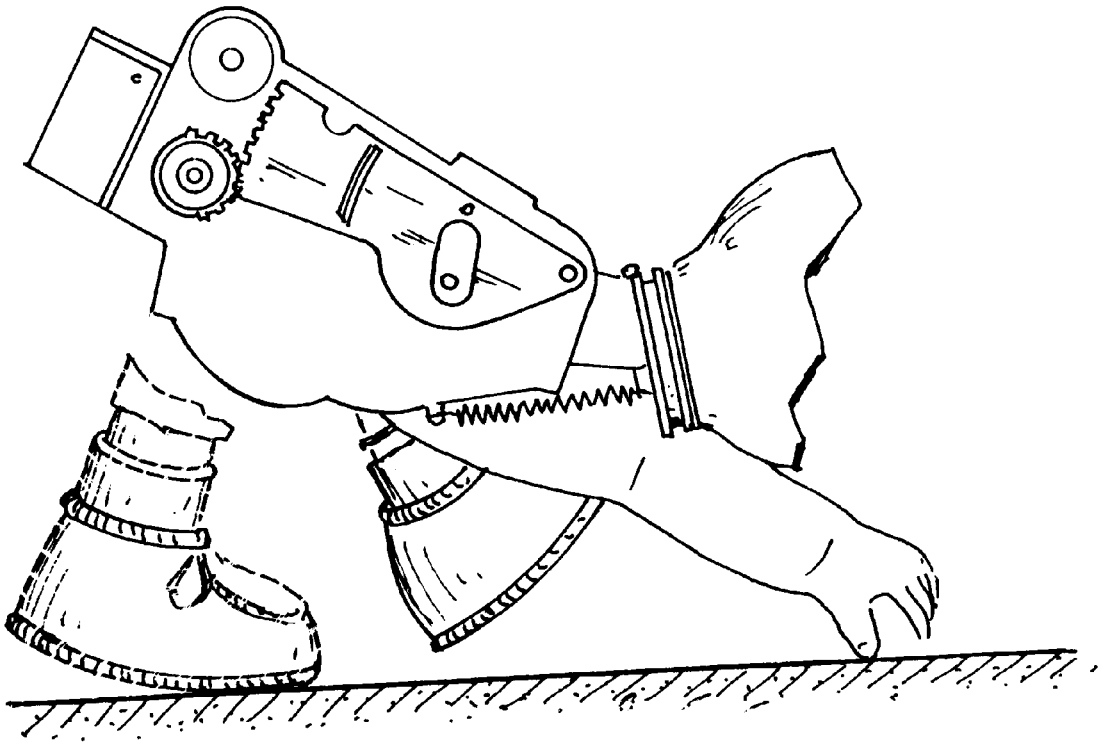
FIG. 14 is similar to FIG. 12, showing an extreme relative position for the trunk and legs.
Figure 15:
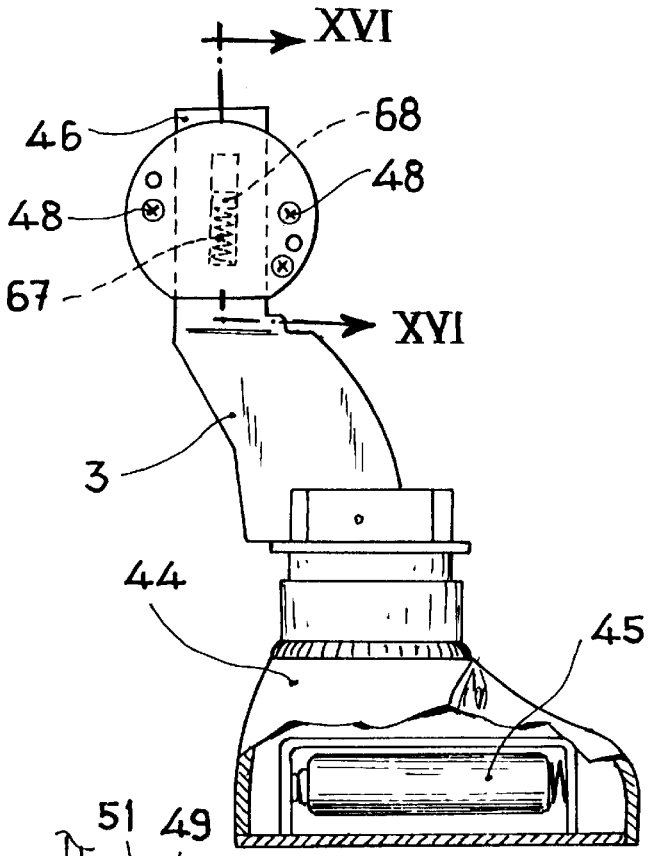
FIG. 15 shows a lateral view of the legs of the inventive doll.

Once the arms 2 are resting on the floor, the doll's trunk 1 is unable to continue its lowering motion, so that, as the relative movement of oscillating toothed sector 66 and circular toothed sector 52 continues, this will necessarily cause the legs to move. Turning now to FIG. 14, corresponding to the doll's lowest falling stance, we see that several position changes have occurred in respect to FIG. 13.

Arms 2 are raised in respect to trunk 1. However, since they continue to rest on the floor, the effect allows for greater absolute tilting on the doll's trunk 1, thus conveying the impression that, in the fall, the arms have given way after resting on the floor.

Since each leg is fitted with an oscillating lever 42 with a trunk stub 41 drawn by the different trunk channels 40 in each face of central wheel 32, a relative movement between both legs 3 can be achieved—up to the position shown in FIG. 13, the legs must remain static and free of relative movement between one another. Thus, as can be seen in FIG. 14, the doll's left leg moves forwards as opposed to the right leg, providing a feeling that it is moving outward in view that the leg rotation axes are not horizontal but directed downwards and outwards, as can be seen in FIG. 6.

In this manner, and through a single movement of the mechanism consisting in a change of the relative position of the oscillating toothed sector 66 in respect to the circular toothed sector 52, three apparent movements are achieved.

a) Forward tilting of the trunk.

b) Opening of the legs 3 towards the exterior.

c) Separation of the legs 3, one towards the front and the other towards the rear.

When the doll reaches the maximum falling position shown in FIG. 14, the movement proceeds in reverse and achieves a first raised condition of trunk 1 by rotating arms 2 downwards to rest on the floor, followed by a mutual drawing near of the legs 3 and finally raising the trunk 1 when the shoes 44 are firmly resting on the floor. During this last raising movement of the trunk 1, the head, which had moved backwards during the fall, gradually returns to its natural position designed to maintain the doll's balance, in a manner similar to the actual raising movement it simulates. At this moment, the arm wheel 33 and the central wheel 32 have ended their cycle after a 360° turn and the latter activates a stop microswitch 64 which cuts the electric supply to the motor 12, stops the second phase of the movement and activates a second timer which, after a specified time, once again connects motor 12 in reverse and again activates the unsteady walking of the first phase of the movement. These subsequent cycles between the first and the second movement phases cease only when the pacifier 5 is inserted in the doll's mouth.

What is claimed is:

1. A doll that walks with unsteady steps and with falling and upright recovery movements, comprising a trunk 1 with jointed arms 2 and legs 3, in addition to a head 4 capable of moving in a front-to-rear direction, and a pacifier 5 for activating the movement, wherein it comprises:

an electric driving motor 12 capable of rotating in either direction, means for controlling the rotating direction of the electric driving motor 12, a clutch assembly comprising a drive wheel 18, a driven wheel 19 and a driven pinion 20 located one on each side of and coaxial to the drive wheel 18 which provides rotating motion through facing front sides having respective surfaces in the form of associated saw teeth 21 and 22, in a manner that, as driven wheel 19 rotates, a first phase of the motion takes place; when the motor is reversed and driven pinion 20 begins rotating, a second phase of the movement takes place, the first phase of the movement consisting in unsteady steps and the second phase of the movement in a fall and subsequent recovery to the upright position, accompanied by movement of the head, means of generating the first phase of the movement, and means of generating the second phase of the movement.

2. A doll that walks with unsteady steps and with falling and upright recovery movements, according to claim 1, wherein the means for controlling the rotating direction of said electric motor 12 comprise a first timer generating a change from the first to the second movement phase, and a stop microswitch 64 for stopping the second movement phase and activating a second timer which, after a specified time, once again starts the first movement phase.

3. A doll that walks with unsteady steps and with falling and upright recovery movements, according to claim 1, wherein the means for generating the first phase of the movement comprise a mechanism consisting in a first phase shaft pinion 23 which, upon meshing with said first phase driven wheel 19, conveys rotation movement to two opposite eccentric discs 25 onto which attach two free connecting rods 26, 27, transforming the rotating movement of the opposite eccentric discs 25 into reciprocating movement of the free connecting rods 26, 27 transmitted to each leg 3 through a leg fork 54 which exerts pressure on a leg stub 53 attached to leg 3.

4. A doll that walks with unsteady steps and with falling and upright recovery movements, according to claim 1, wherein the means for generating the second phase of the movement comprise:

a rotating arm wheel 33 which presents an arm channel 34 designed to receive a stub 36 of a rack 37 which, upon sliding in the direction of the diameter of the arm wheel 33, meshes with an arm pinion 38 that is coaxial and integral to rotating arm shaft 6 and the arms 2 proper, said arm wheel 33 receiving the rotating movement from said second phase driven pinion 20 through a second phase shaft wheel 28 integral to a second phase shaft 29 to which is attached a first 2nd phase pinion 30 which in turn meshes with the arm wheel 33 itself, a central wheel 32 fitted, on each of its side faces, with a trunk channel 40 for receiving a trunk stub 41 of an oscillating lever 42 hinged to an oscillating shaft 43 fixed to trunk 1, in a manner that, when an oscillating toothed sector 66 located at the lower end of said oscillating lever 42 meshes onto a circular toothed sector 52 rigidly rotational with legs 3, a relative movement is generated between the trunk 1 and each leg 3, a head cam 57 which receives rotational movement from said central wheel 32 through indentations 58 in the facing surfaces of both parts, said head cam 57 acting on a driven stub 59 fitted in a head auxiliary lever 60 which, hinged onto an inner projection of a fork protrusion 9, allows for head 4 movement as a result of the action from head stub 61 that is integral to said head auxiliary lever 60 in the groove 62 of a head fork 8 which, hinged to the head fork protrusions 9, is integral to the head.

* * * * *